US007464691B2

(12) United States Patent
Conner

(10) Patent No.: US 7,464,691 B2
(45) Date of Patent: Dec. 16, 2008

(54) MIXING ELEMENT FOR CREATING A VORTEX MOTION IN AN INLET MANIFOLD OF AN INTERNAL COMBUSTION ENGINE

(76) Inventor: David Conner, 26 Bargrange Avenue, Shipley (GB) BD18 2AA ( * ) Notice: Subject to any disclaimer, the term of this patent is extended or adjusted under 35 U.S.C. 154(b) by 0 days.

(21) Appl. No.: 11/791,061

(22) PCT Filed: Mar. 24, 2005

(86) PCT No.: PCT/GB2005/001209

§ 371 (c)(1),
(2), (4) Date: May 18, 2007

(87) PCT Pub. No.: WO2006/054037

PCT Pub. Date: May 26, 2006

(65) Prior Publication Data

US 2008/0115774 A1 May 22, 2008

(30) Foreign Application Priority Data

Nov. 19, 2004 (GB) ..... 0425474.4

(51) Int. Cl.
*F02M 29/02* (2006.01)

(52) U.S. Cl. ..... 123/306; 123/337; 123/592

(58) Field of Classification Search ..... 123/306, 123/337, 590, 592
See application file for complete search history.

(56) References Cited

U.S. PATENT DOCUMENTS

| | | | | |
|---|---|---|---|---|
| 1,568,410 | A * | 1/1926 | Minter | 123/590 |
| 1,684,480 | A * | 9/1928 | Evans | 48/189.4 |
| 3,938,967 | A | 2/1976 | Reissmuller | |
| 3,946,717 | A * | 3/1976 | England | 123/592 |
| 4,307,697 | A | 12/1981 | Ong | |
| 4,359,997 | A | 11/1982 | Lyssy | |
| 4,962,642 | A * | 10/1990 | Kim | 60/272 |
| 5,171,487 | A | 12/1992 | Hudz | |
| 5,638,797 | A * | 6/1997 | Kim | 123/592 |
| 5,685,281 | A | 11/1997 | Li | |
| 6,006,721 | A | 12/1999 | Shannon et al. | |
| 6,536,420 | B1 * | 3/2003 | Cheng | 123/590 |
| 7,104,251 | B2 * | 9/2006 | Kim | 123/306 |
| 2003/0150439 | A1 | 8/2003 | Hsu | |
| 2006/0162690 | A1 * | 7/2006 | Kim | 123/306 |

FOREIGN PATENT DOCUMENTS

| | | |
|---|---|---|
| DE | 3711859 | 10/1987 |
| DE | 10124859 | 11/2002 |
| DE | 20307755 | 10/2003 |
| FR | 2417018 | 9/1979 |
| GB | 25481 | 11/1913 |
| GB | 1472592 | 5/1977 |
| GB | 2065222 | 6/1981 |
| SU | 992782 | 1/1983 |
| WO | WO03/104624 | 12/2003 |

* cited by examiner

*Primary Examiner*—Erick Solis
(74) *Attorney, Agent, or Firm*—James Creighton Wray; Clifford D. Hyra

(57) ABSTRACT

A device configured to impart a vortex motion in a fluid for an internal combustion engine, the internal combustion engine comprising a throttle. The device comprises at least one mixing element, the mixing element being disposed transversely to a main direction of a flow of said air/fuel mixture, and the device is configured to be disposed downstream of the throttle.

4 Claims, 9 Drawing Sheets

MIXING ELEMENT FOR CREATING A VORTEX MOTION IN AN INLET MANIFOLD OF AN INTERNAL COMBUSTION ENGINE

This application claims the benefit of GB Application No. 0425474.4 filed Nov. 19, 2004 and PCT/GB2005/001209 filed Mar. 24, 2005, which are hereby incorporated by reference in their entirety.

FIELD OF THE INVENTION

The present invention relates to the field of improvements to the internal combustion engine, and in particular to devices configured to impart a vortex motion in a fluid for an internal combustion engine.

BACKGROUND TO THE INVENTION

The internal combustion engine has been the subject of many improvements and developments over the past century. With increasing oil prices, and dwindling oil reserves, it is desirable to make the internal combustion engine more efficient than it currently is.

Furthermore, the internal combustion engine gives off exhaust gases that can be harmful to the environment. By improving the efficiency of the internal combustion engine, a quantity of exhaust gas given off by an internal combustion engine is reduced.

Improving the efficiency of the internal combustion engine therefore has two beneficial effects: The first is that the engine will use less fuel and therefore be more economical, and the second is that the engine will emit less exhaust gas, and therefore be less harmful to the environment.

One way to improve the efficiency of the internal combustion engine is to improve the air/fuel mixture in the combustion chamber. The air/fuel mixture is regulated to a large extent by either direct injection of the fuel into air in the combustion chamber of the engine cylinder on the compression stroke or indirect injection of the fuel into the air prior to it entering the cylinder. The air/fuel mixture can also be regulated by a carburetor, which mixes the air and fuel prior to the air/fuel mixture passing down an inlet manifold into the cylinder. In all cases the fuel is mixed with air in the form of droplets of fuel carried in an air flow into the combustion chamber of a internal combustion engine. During the combustion process the size and dispersal of the fuel droplets determines the efficiency of the burn and the energy released and so the efficiency of the engine.

Ways of improving the mixture include improving the atomization of the fuel in the air/fuel mixture, and increasing the turbulence of the air/fuel mixture.

Atomization of fuel can be improved by using heat from the engine block to increase the degree of atomization. Further methods of improving atomization of fuel include having vanes or blades that cause liquid fuel droplets to fragment on impact with the vanes or blades and form smaller droplets, thereby improving the air/fuel mixture.

Another way of improving the air/fuel mixture is to generate a vortex in the air/fuel mixture. US2003/015049 discloses a vortex generator for an engine. The vortex generator includes a tubular body with a plurality of curved blades. When moving air passes through the tubular body the curved blades redirect the air to form a vortex, such that the air swirls around an axis of a main length of the tubular body.

However, the vortex generator described is not suitable for an internal combustion engine having a throttle. The vortex generator is described as being located before an air filter, or between the air filter and the engine. Where the vortex generator is disposed upstream of an air filter, then the air filter will substantially destroy the vortex. Where the vortex generator is disposed downstream of the air filter, the swirling air will mix with the fuel and enter the engine. However, for an internal combustion engine that is required to be used at different speeds, in particular internal combustion engines used in vehicles, a throttle is required. The throttle, when closed or partially closed, would substantially destroy the vortex, thereby reducing the benefits of having the swirling airflow.

Referring to FIG. 1 herein, there is illustrated schematically a prior art internal combustion engine. In FIG. 1A, the internal combustion engine comprises a carburetor 101, a throttle 102, an inlet manifold 103 and the engine itself 104. In FIG. 1B, the internal combustion engine comprises an indirect injector 105. In FIG. 1C, the internal combustion engine comprises a direct injector 106.

Referring to FIG. 1A, the carburetor 101 is configured to mix air and fuel in the correct proportions to form a combustible mixture. The carburetor 101 essentially comprises at least one jet discharging the fuel into an airstream under the pressure difference created by the velocity of the air as it flows through a nozzle shaped construction. The throttle 102 allows a user to control the quantity of air/fuel mixture that is drawn into the combustion chamber of the engine 104. The inlet manifold 103 allows the air/fuel mixture to be drawn into the desired chambers of the engine 104. The engine 104 is where combustion of the air/fuel mixture takes place, converting the chemical energy of the air/fuel mixture into kinetic energy.

Referring to FIG. 1B, the indirect injection 105 system comprises at least one jet discharging fuel under pressure through an injector nozzle. Fuel is injected into the manifold 103 at a point before an inlet valve to a combustion chamber in the engine 104. A carburetor 101 is therefore nor required.

Referring to FIG. 1C, the direct injection system 106 discharges fuel directly into the air inside a cylinder of the engine 104. A carburetor 101 is therefore not required.

SUMMARY OF THE INVENTION

The inventor has realised the problems associated with the prior art devices for improving the efficiency of the internal combustion engine, and has devised a vortex generator for an internal combustion engine having a throttle, the vortex generator being configured to be disposed at or downstream of the throttle. In further embodiments, the device is formed integrally with the throttle or integrally with an inlet manifold.

According to a first aspect there is provided an internal combustion engine comprising:

a throttle at least one mixing element, the mixing element being disposed transversely to a main direction of a flow of a fluid, and the mixing element configured to impart a vortex motion in the fluid;

the mixing element configured to be located at or downstream of the throttle.

Preferably, the mixing element comprises a plurality of vanes, each vane of the plurality of vanes being disposed transversely to a main direction of a flow of the fluid.

Preferably, each the vane, is disposed at substantially 45° relative to a main direction of the flow of the fluid.

Preferably, each the vane is permanently fixed in a predetermined disposition.

Alternatively, the mixing element is formed as part of the throttle, the throttle comprising a plurality of vanes, each the vane configured to control a degree of flow of the fluid and each the vane also configured to generate a vortex in the fluid when the fluid is allowed to flow.

Preferably, the throttle comprises:

at least one drive gear;

at least one vane spindle gear;

wherein each the gear is operatively connected to a vane; and a rotation of the drive gear effects a rotation of the vane spindle gear, thereby effecting movement of each the vane.

Alternatively, the mixing element is configured to be disposed between a throttle and an inlet manifold of the internal combustion engine.

Alternatively, the mixing element is formed integrally with an inlet manifold of the internal combustion engine.

Alternatively, the mixing element comprises an air inlet opening into a manifold, the air inlet opening having a radial axis that is not concentric with a main radial axis of the manifold.

Alternatively, the mixing element comprises an air inlet opening into a plenum chamber, the air inlet opening having a radial axis that is not concentric with a main radial axis of the plenum chamber.

According to a second aspect there is provided a device configured to impart a vortex motion in a fluid for an internal combustion engine, the internal combustion engine comprising a throttle, the device comprising:

at least one mixing element, the mixing element being disposed transversely to a main direction of a flow of the fluid;

the device configured to be disposed at or downstream of the throttle.

Preferably, the mixing element comprises a plurality of vanes, each vane of the plurality of vanes being disposed transversely to a main direction of a flow of the fluid.

Preferably, each the vane, when in use, is disposed at substantially 45° relative to a main direction of the flow of the fluid.

Preferably, the vane is configured to be permanently fixed in a predetermined disposition.

Alternatively, the mixing element if formed as part of the throttle, the throttle comprising a plurality of vanes, each the vane configured to control a degree of flow of the fluid and each the vane also configured to generate a vortex in the fluid when the fluid is allowed to flow.

Preferably, the throttle comprises:

at least one drive gear;

at least one vane spindle gear;

wherein each the gear is operatively connected to a vane; and a rotation of the drive gear effects a rotation of the vane spindle gear, thereby effecting movement of each the vane.

Preferably, the device is configured to be disposed between the throttle and an inlet manifold of the internal combustion engine.

Alternatively, the device is formed integrally with an inlet manifold of the internal combustion engine.

Alternatively, the mixing element comprises an air inlet opening into a manifold, the air inlet opening having a radial axis that is not concentric with a main radial axis of the manifold.

Alternatively, the mixing element comprises an air inlet opening into a plenum chamber, the air inlet opening having a radial axis that is not concentric with a main radial axis of the plenum chamber.

BRIEF DESCRIPTION OF THE DRAWINGS

For a better understanding of the invention and to show how the same may be carried into effect, there will now be described by way of example only, specific embodiments, methods and processes according to the present invention with reference to the accompanying drawings in which.

DETAILED DESCRIPTION

There will now be described by way of example a specific mode contemplated by the inventor. In the following description numerous specific details are set forth in order to provide a thorough understanding. It will be apparent however, to one skilled in the art, that the present invention may be practiced without limitation to these specific details. In other instances, well known methods and structures have not been described in detail so as not to unnecessarily obscure the description.

Reference is made throughout this description to air, an air/fuel mixture and fluid. The term 'fluid' is used herein to refer to either air or an air/fuel mixture.

According to a first specific embodiment there is provided a fixed vane rotator disposed between the throttle 102 and the inlet manifold.

Figure 1:
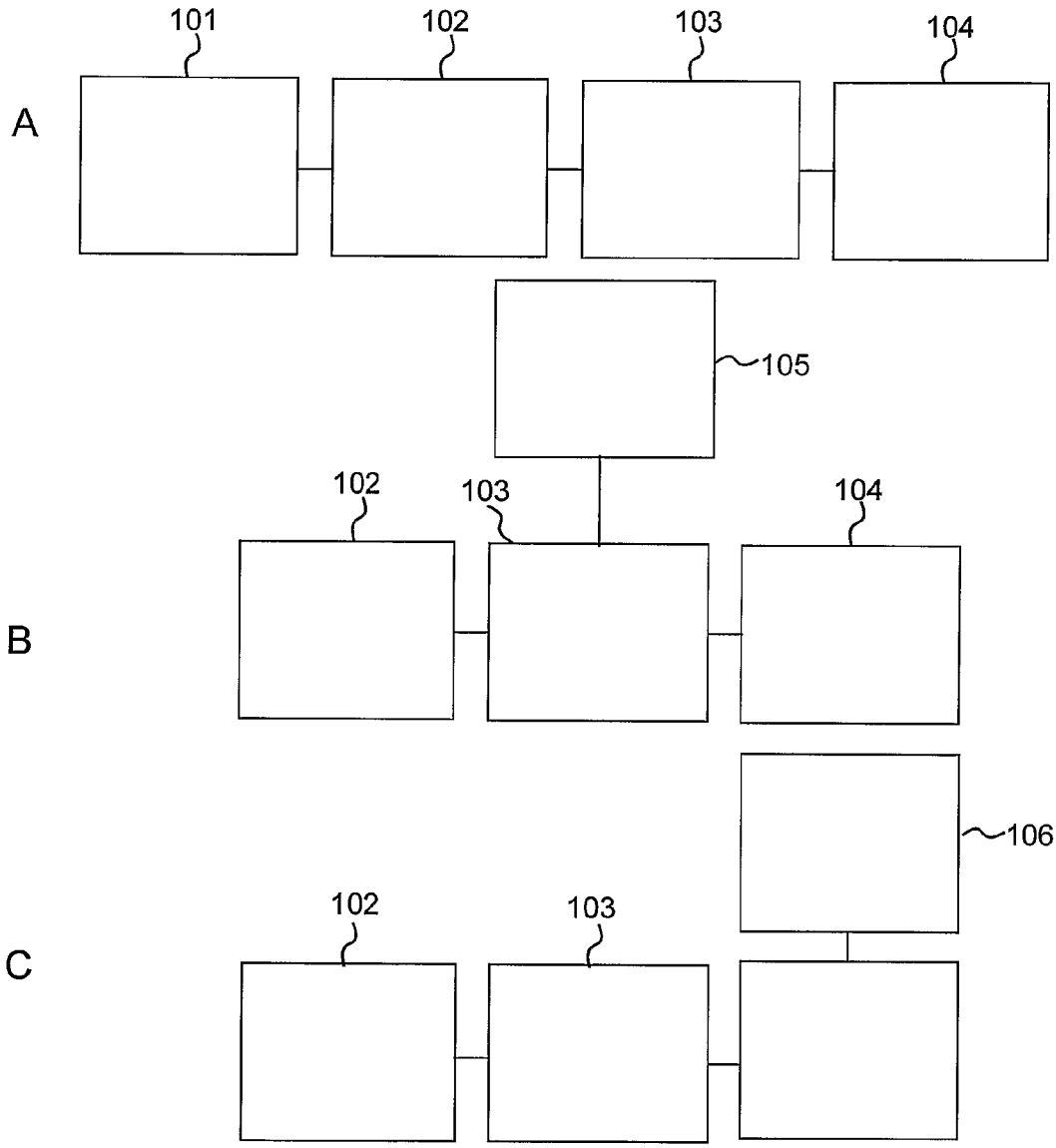
Fig. 1 (Prior Art)
FIG. 1 illustrates schematically three prior art internal combustion engines, having a carburetor (FIG. 1A), an indirect fuel injection system (FIG. 1B) and a direct fuel injection system (FIG. 1C).
Figure 2:
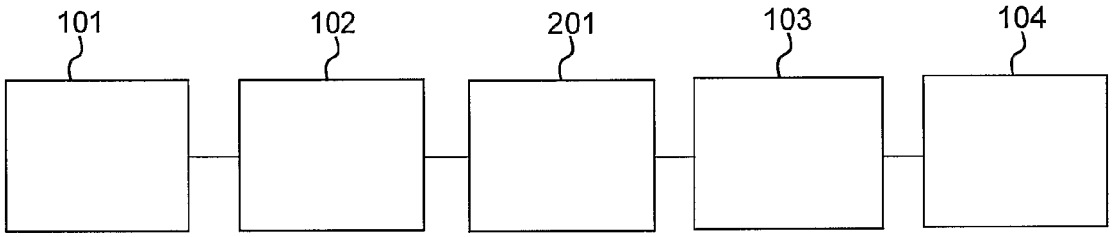
FIG. 2 illustrates schematically an internal combustion engine according to a first specific embodiment of the invention.

Referring to FIG. 2 herein, there is illustrates schematically an internal combustion engine according to the first specific embodiment. The internal combustion engine comprises a carburetor 101, a throttle 102, a fixed vane rotator 201, an inlet manifold 103 and the engine 104. The relative positions of these items in terms of the flow of the air/fuel mixture are as follows: The throttle 102 is disposed downstream to the carburetor 101, the fixed vane rotator 201 is disposed downstream of the throttle 102, the inlet manifold 103 is disposed downstream of the fixed vane rotator 201, and the engine 104 is disposed downstream of the inlet manifold 103.

The rotator comprises a mixing element, which is configured to cause the air/fuel mixture to swirl or rotate prior to it entering the inlet manifold. The mixing element can comprise any one of several different types, including but not limited to profiling on the surface of the rotator, fixed vanes, movable vanes, blades and so on.

Rotation of the air/fuel mixture improves the efficiency of the internal combustion engine in several ways.

Rotation of the air/fuel mixture passing through the inlet manifold increases the distance it must travel compared to a linear movement of the air/fuel mixture over the same linear distance. Because the volume of the air/fuel mixture and the overall linear speed is similar for an air/fuel mixture that is rotating and for an air/fuel mixture that is not rotating, the air/fuel mixture that is rotating will have a higher overall speed caused by rotation.

The higher speed of movement of the air/fuel mixture means that the air/fuel mixture enters the engine 104 with more energy. This improves the efficiency of combustion.

Rotation of the air/fuel mixture also reduces the turbulence of the air/fuel mixture as it enters an inlet valve (not shown) of the engine 104. When the inlet valve is closed the rotation of the air/fuel mixture and the energy carried results in compression of the air/fuel mixture upstream of the closed valve. The compressed air/fuel mixture will continue to rotate behind the closed valve thereby retaining its speed and rotation momentum. Once the valve opens, the maintained rotational momentum will allow the air/fuel mixture to enter into a cylinder head (not shown) of the engine 104 at a higher speed than if the air/fuel mixture was not rotating. Furthermore, rotation of the air/fuel mixture allows a more streamlined entry into the cylinder head because the direction of the flow is almost parallel to the rear of the inlet valve and the valve seat (not shown).

The volume of the air/fuel mixture entering the cylinder head is increased because the air/fuel mixture is more efficiently compressed when the valve is closed. When the valve is opened, the compressed air/fuel mixture enters the cylinder head, and therefore there is a greater mass of air/fuel mixture than if the air/fuel mixture was not rotating. This further increases the efficiency of the internal combustion engine.

The rotation of the air/fuel mixture improves the distribution of fuel within the air/fuel mixture. Having improved distribution of fuel in the air/fuel mixture gives rise to a more efficient burn of the air/fuel mixture in the engine 104.

Further advantages of having a rotating air/fuel mixture include reducing turbulence of the air/fuel mixture. This allows a designer to include more or sharper changes of direction in the engine manifold, without creating further significant turbulence or reducing the speed of movement of the air/fuel mixture. Since a rotating air/fuel mixture can travel further and carry a higher momentum than a conventional linearly or turbulently moving air/fuel mixture, the manifold can be made more compact than conventional designs by incorporating tighter bends.

Figure 3:
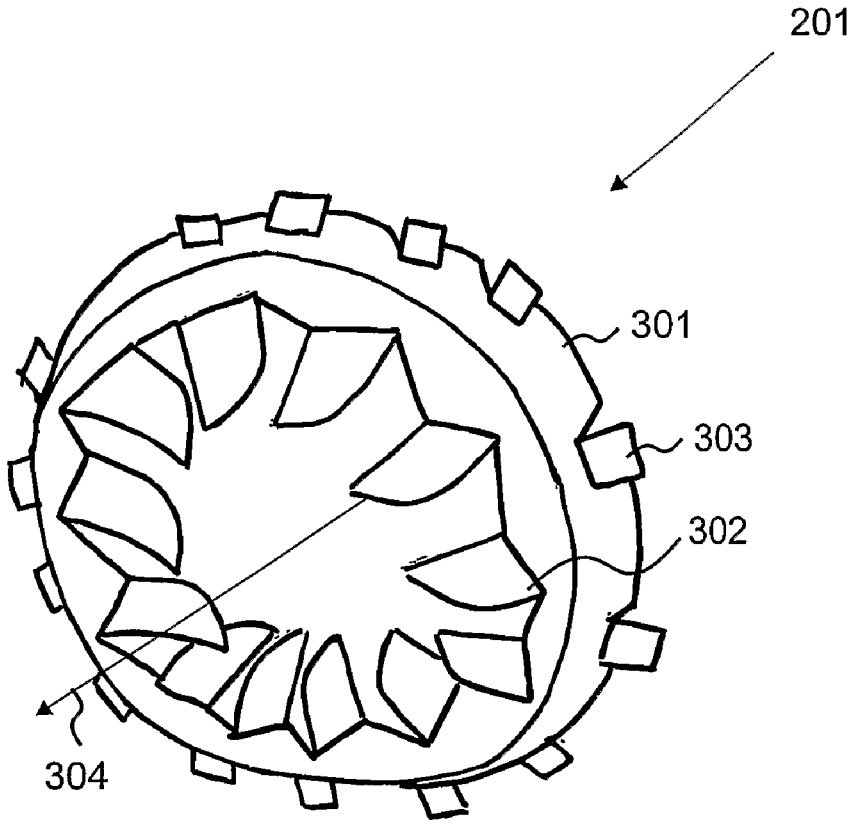
FIG. 3 illustrates schematically a perspective view of a fixed vane rotator according to the first specific embodiment.

Referring to FIG. 3 herein, there is illustrated schematically a perspective view of the fixed vane rotator 201 according to the first specific embodiment. The fixed vane rotator 201 comprises an outer tubular body 301. The tubular body 301 comprises a plurality of vanes 302. The vanes 302 are angled relative to the cylindrical axis 304 of the tubular body 301. The air fuel air/fuel mixture enters the fixed vane rotator 201 travelling in a linear or turbulent manner. The vanes 302 located on an inner surface of the tubular body 301 cause the air/fuel mixture to swirl and flow in a vortex configuration.

The size and angle of the vanes 302 relative to the tubular body 301 can be varied to maximise the efficiency of the rotation. It is currently thought that an angle of 45° for each vane 302 gives the maximum efficiency of rotation.

The tubular body 301 is also provided with a series of lugs 303 that are configured to interact with an inner surface of an inlet manifold of an existing engine, and fix the fixed vane rotator 201 in place. This allows the fixed vane rotator 201 to be retrofitted to the inlet manifold of an existing engine.

Alternatively, the vanes 302 may be located in a separate tubular body 301 that is disposed between the throttle 102 and the inlet manifold 103. Alternatively, the vanes 302 can be disposed as part of the throttle assembly behind the throttle valve, or as part of the inner surface of the air inlet to the inlet manifold. Where the vanes 302 are disposed as part of the throttle assembly behind the throttle valve, or as part of the inner surface of the air inlet to the inlet manifold they can be fitted to an existing throttle assembly or inlet manifold, or be formed integrally with a throttle assembly or inlet manifold.

According to a second specific embodiment, the rotation device comprises a plurality of moveable vanes formed as part of a throttle valve in a throttle assembly.

Figure 4:
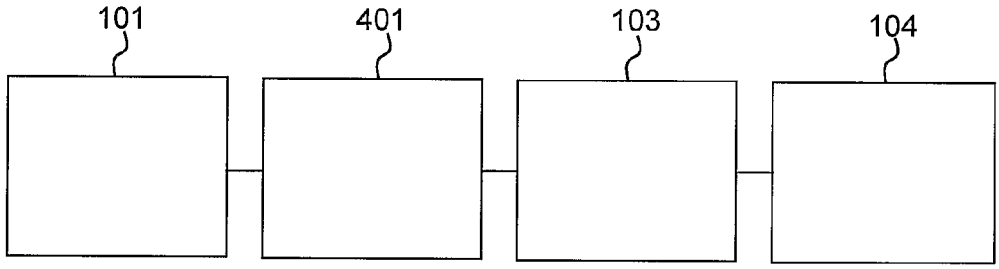
FIG. 4 illustrates schematically an internal combustion engine according to a second specific embodiment.

Referring to FIG. 4 herein, there is illustrates schematically an internal combustion engine according to the second specific embodiment.

The internal combustion engine comprises a carburetor 101, a throttle 401 comprising a plurality of moveable vanes formed as part of a throttle valve in a throttle assembly, an inlet manifold 103 and the engine 104.

Conventional throttle valves can be as simple as a mechanical flap that can be positioned to open or partially block the flow of the air/fuel mixture. The user can control to alter the amount of air/fuel mixture going to the engine using the throttle valve. According to the second specific embodiment, the throttle assembly comprises a plurality of vanes that perform the dual function of controlling the amount of air/fuel mixture going to the engine and also controlling the degree of rotation of air/fuel mixture/

Figure 5:
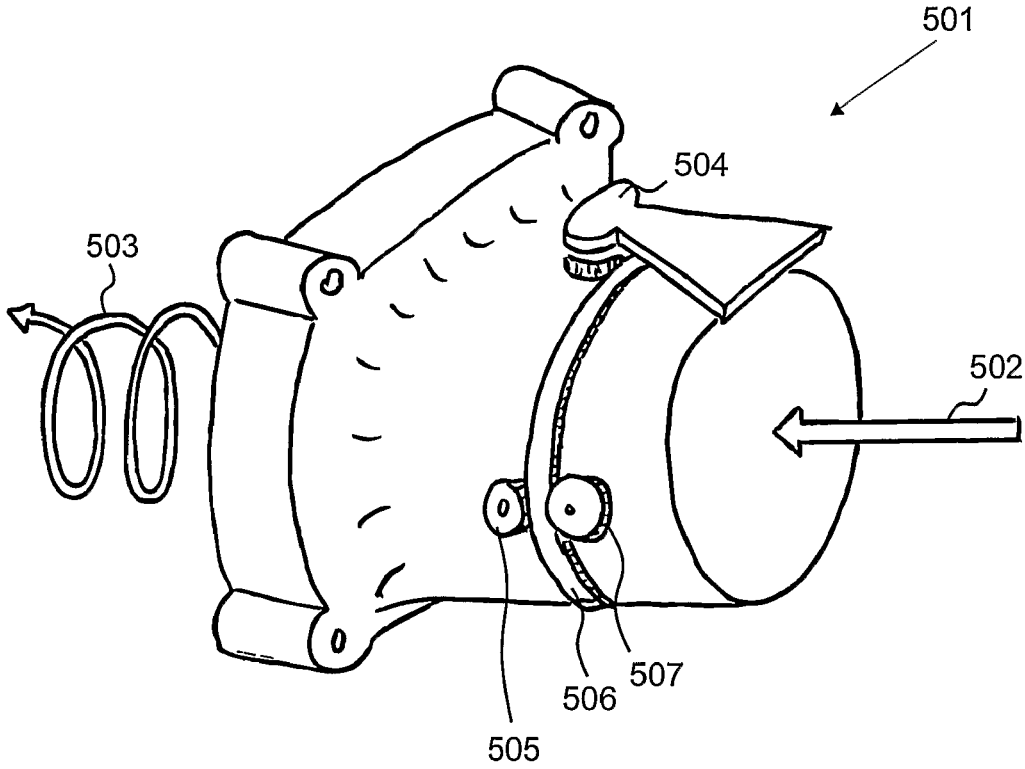
FIG. 5 illustrates schematically a perspective view of a throttle assembly according to the second specific embodiment.

Referring to FIG. 5 herein, there is illustrated schematically a perspective view of the throttle assembly according to a second specific embodiment. The throttle assembly 501 comprises an air/fuel mixture inlet 502 and an air/fuel mixture outlet 503. The throttle assembly 501 further comprises a primary drive gear 504, a plurality of vane spindle gears 505 and a throttle ring 506.

The primary drive gear 504 is controlled by the user to control the amount of air/fuel mixture that is sent to the engine 104. The primary drive gear 504 is operatively connected to the throttle ring such that when the primary drive gear 504 is rotated by the user, the throttle ring 506 also rotates. Rotation of the throttle ring 506 is operatively connected to the vane spindle gears 505, such that rotation of the throttle ring 506 effects rotation of the vane spindle gears 505. Each vane spindle gear 505 has an opposing idle gear 507. The idle gears 507 are configured to hold the throttle ring 506 in place such that it remains operatively connected to the vane spindle gears 505.

Figure 6:
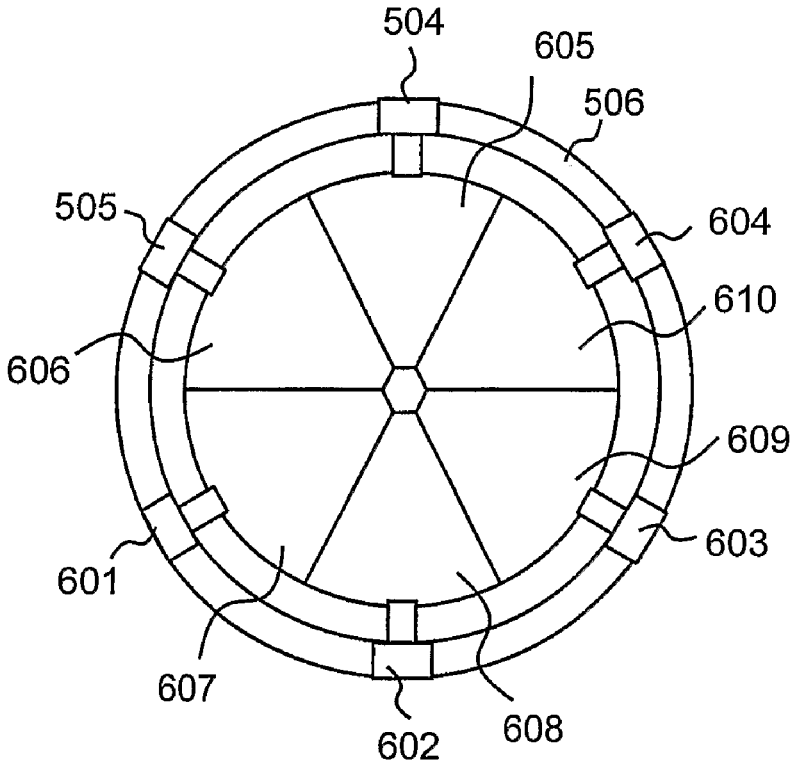
FIG. 6 illustrates schematically a cross-section view of the throttle assembly in the closed configuration according to the second specific embodiment.

Referring to FIG. 6 herein there is illustrated schematically a cross-section view of the throttle assembly in the closed configuration according to the second specific embodiment.

There is illustrated the primary drive gear 504, a plurality of vane spindle gears 505, 601, 602, 603, 604. Each gear 504, 505, 601, 602, 603, 604 is operatively connected to a vane 605, 606, 607, 608, 609, 610. The primary drive gear 504 is connected to the first vane 605. The vane spindle gears 505, 601, 602, 603, 604 are connected to vanes 606, 607, 608, 609, 610 respectively.

When the primary drive gear 504 is not moved by a user it remains in a closed configuration. Vane 605 is therefore in a position to restrict the flow of the air/fuel mixture. As the vane spindle gears 505, 601, 602, 603, 604 all move in response to movement of the primary drive gear 504, the other vanes 606, 607, 608, 609, 610 are also disposed therefore in a position to restrict the flow of the air/fuel mixture.

Figure 7:
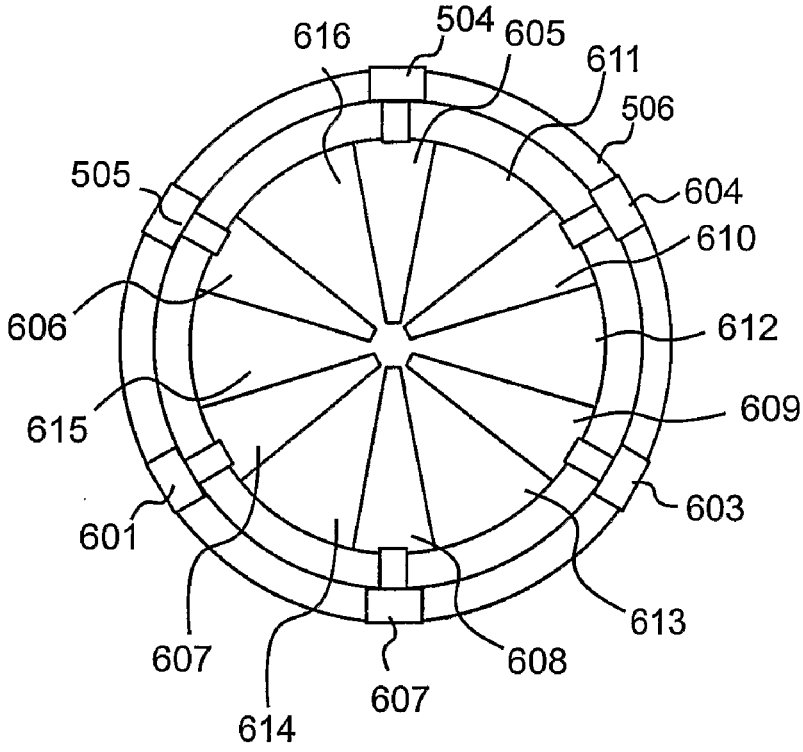
FIG. 7 illustrates schematically a cross-section view of the throttle assembly in a fully open configuration according to the second specific embodiment.

Referring to FIG. 7 herein, there is illustrated schematically a cross-section view of the throttle assembly in a fully open configuration according to the second specific embodiment.

When the user activates the throttle 501, the primary drive gear 504 rotates the vane 605 such that the vane is disposed at up to 180° from the main cylindrical axis of the throttle assembly 501.

The vanes have an aerofoil-shaped cross-section to further improve the efficiency of generating a vortex.

The primary drive gear 504 is operatively connected to the throttle ring 506 such that rotation of the drive gear 504 in addition to rotating and opening the first vane 605 also causes a rotation of the throttle ring 506. The throttle ring 506 is operatively connected to the vane spindle gears 505, 601, 602, 603, 604. When the throttle ring 506 is rotated by the primary drive gear 504 rotation of the vane spindle gears 505, 601, 602, 603, 604 is also affected. As the vane spindle gears 505, 601, 602, 603, 604 are operatively connected to vanes 606 to 610 respectively, vanes 606 to 610 are rotated through up to 45°.

Rotation of the vanes 605 to 610 opens the throttle assembly to allow passage of the air-fuel mixture through gaps 6611-616, thereby allowing the air/fuel mixture to the engine 104. Rotation of the vanes 605 to 610 also causes the vanes 605-610 to be disposed at an angle to the main direction of air/fuel flow. In this way, the vanes 605-610 act as a vortex generator and cause swirling of the air/fuel mixture.

The angle of the vane to the airflow can be varied to improve efficiency at different engine speeds, as the degree of vortex generated affects the degree of mixing between the fuel and the air, and the speed of movement of the air/fuel mixture.

Figure 8:
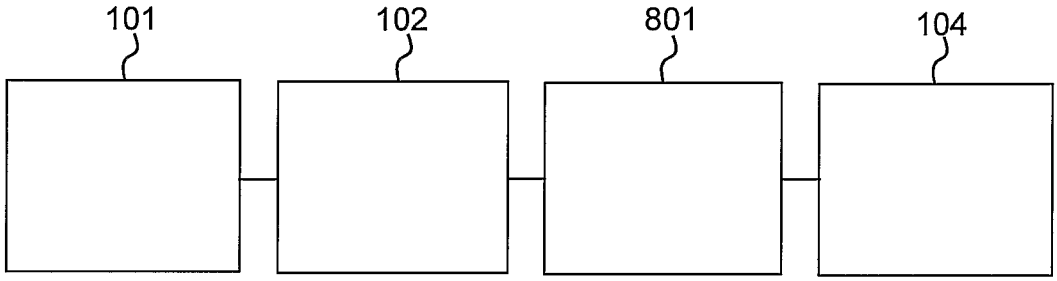
FIG. 8 illustrates schematically an internal combustion engine according to a third specific embodiment.

Referring to FIG. 8 herein, there is illustrated schematically an internal combustion engine according to the third specific embodiment. The internal combustion engine comprises a carburetor 101, a throttle 102, an inlet manifold incorporating a rotation device 701 and the engine 104.

The inlet manifold 701 comprises a plurality of guides or vanes along a length of the manifold guiding the air into the separate inlet tubes and imparting a rotation of the air/fuel mixture. These guides or vanes cause the air/fuel mixture to swirl as they enter the engine.

Figure 9:
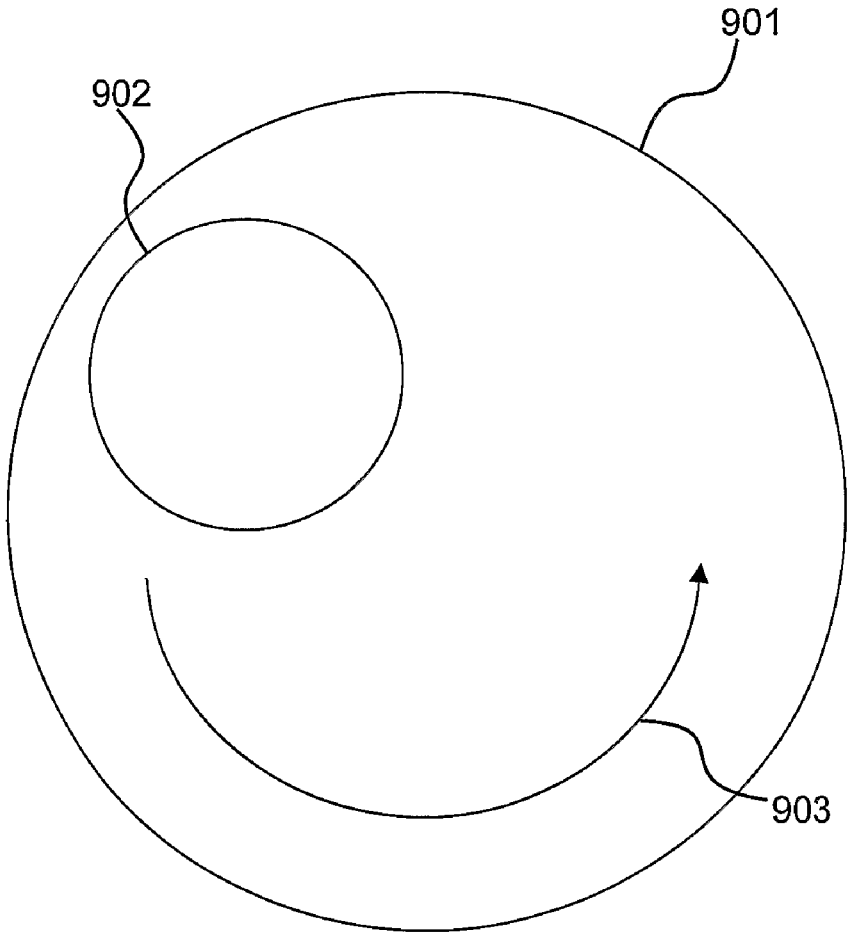
FIG. 9 illustrates schematically a cross-section view of an arrangement for imparting a vortex motion into a fluid according to a fourth specific embodiment.

According to a fourth specific embodiment, there is provided an inlet pipe that enters a plenum chamber or main tube of the manifold at an off-centre position. Referring to FIG. 9 herein, there is illustrated schematically a cross-section view of an arrangement for imparting a vortex motion into a fluid according to a fourth specific embodiment.

The air inlet 902 into a manifold 901 has a radial axis that is not concentric with a radial axis of the manifold 903. Because air enters a larger space in the manifold 901 from the air inlet 902 at an offset position, the natural tendency of the air is to adopt a swirling or vortex motion 903 as it enters the manifold. The air inlet 902 may be disposed such that is enters the manifold 901 at one end of the manifold. Alternatively, the air inlet 902 may enter the manifold tangentially to increase the degree of vortex motion that is generated.

A similar effect can be achieved by providing an off-set outlet pipe from the plenum chamber or the manifold. In the fourth specific embodiment, the mixing element comprises an offset air inlet or air outlet.

The invention claimed is:

1. A throttle for an internal combustion engine, comprising:

a plurality of vanes disposed transversely to a main direction of flow of fluid through said throttle, each said vane having an axis about which it is configured to rotate, a plurality of vane spindle gears, each said vane spindle gear operatively connected to a vane, and a throttle ring operatively connected to said plurality of vane spindle gears such that rotation of said throttle ring effects a rotation of each vane spindle gear, thereby effecting movement of each said vane;

each said vane is configured to control a degree of flow of fluid through said throttle and each said vane is also configured to generate a vortex in a fluid allowed to flow through said throttle, and said vanes are arranged to rotate about their axes under the control of a user such that in use said vanes control the amount of an air/fuel mixture going to an engine and control the degree of rotation of said air/fuel mixture; wherein one of said vane spindle gears is arranged as a primary drive gear configured to be controlled by a user and such that when said primary drive gear is rotated by a user the throttle ring also rotates.

2. A throttle as claimed in claim 1, wherein each vane spindle gear has an opposing idle gear configured to hold the throttle ring in place such that it remains operatively connected to the vane spindle gears.

3. An internal combustion engine having a throttle, for controlling the quantity of air/fuel mixture drawn into said engine, according to claim 1.

4. An internal combustion engine having a throttle, for controlling the quantity of air/fuel mixture drawn into said engine, according to claim 2.

* * * * *